US005289777A

United States Patent [19]

Sippel et al.

[11] Patent Number: 5,289,777

[45] Date of Patent: Mar. 1, 1994

[54] SUBCALIBER KINETIC ENERGY PROJECTILE

[75] Inventors: Achim Sippel; Heinz-Josef Kruse, both of Ratingen; Walter Klumpp, Duisburg; Jürgen Böcker, Oberhausen; Jürgen Meyer, Cologne; Michael Geis, Witten; Rolf Holl, Düsseldorf, all of Fed. Rep. of Germany

[73] Assignee: Rheinmetall GmbH, Ratingen, Fed. Rep. of Germany

[21] Appl. No.: 25,400

[22] Filed: Feb. 26, 1993

[30] Foreign Application Priority Data

Feb. 28, 1992 [DE] Fed. Rep. of Germany ..... 4206217

[51] Int. Cl.[5] ..... F42B 14/06

[52] U.S. Cl. ..... 102/521

[58] Field of Search ..... 102/520–523, 102/703

[56] References Cited

U.S. PATENT DOCUMENTS 4,608,927 9/1986 Romer et al. .

4,779,536 10/1988 Luther et al. ..... 102/521

5,025,731 6/1991 Meyer et al. ..... 102/521

FOREIGN PATENT DOCUMENTS

0086711 A1 8/1983 European Pat. Off. .

0417012 A1 3/1991 European Pat. Off. .

*Primary Examiner*—Harold J. Tudor

*Attorney, Agent, or Firm*—Spencer, Frank & Schneider

[57] ABSTRACT

A subcaliber kinetic energy projectile (1) including a penetrator (2) and a segmented sabot (3) which is provided with a front support (4) and with a second support (5) that is disposed at an axial distance behind the first support, with the second support (5) including a rotationally symmetrical air pocket (6) that faces the first support (4) and the first support (4) is provided with air passage openings (43, 44, 45).In the sabot, the relationship of $L/D \geqq 1.2$ exists between the length L of the penetrator tip (8) ahead of the first support (4) and the caliber D. The relationship $x \geqq 0.45 * \iota$ further applies between the distances x and $\iota$, with x being the distance between the trailing edge (10) of the sabot and the base surface (11) of the air pocket (6) in the second support (5) and $\iota$ being the distance between the trailing edge (10) of the sabot (3) and the leading edge (12) of the sabot at the surface of the penetrator (2). Finally, the first support (4) is composed of at least three laterally extending web-like components (40–42) whose shape and dimensions are such that they form and have the effect of three separate air pockets.

9 Claims, 4 Drawing Sheets

SUBCALIBER KINETIC ENERGY PROJECTILE

BACKGROUND OF THE INVENTION

The present invention relates to a subcaliber kinetic energy projectile including a penetrator and a segmented sabot of the type provided with a forward support and a further support disposed at an axial distance behind the front support, with the further support including a rotationally symmetrical air pocket facing the forward support which is provided with air passages.

A kinetic energy projectile of the above type is disclosed, for example in Germin laid open patent application No. DE-OS 3,324,749 which corresponds to U.S. Pat. No. 4,608,927. This projectile is provided with a sabot that has a first front support and a second support arranged at an axial distance behind the first support. The second support includes an air pocket facing the first support which causes the sabot segments to be released from the penetrator by the inflowing air as soon as the kinetic energy projectile has left the gun tube.

The first support is composed of individual radially extending webs or flanges between which air flow openings are disposed and which preferably are provided with intended break locations so that the first support is able to break off. The dimensions of the webs are selected such that the webs serve primarily to support the kinetic energy projectile against the gun tube and do not perform the function of an air pocket to open the sabot because there exists the danger that pressure fluctuations become noticeable in such a forward air pocket and thus cause the projectile to perform pendulum movements. Such pressure fluctuations occur primarily in projectile configurations in which the length L of the penetrator tip disposed ahead of the first rotationally symmetrical air pocket (the exposed penetrator tip) is relatively short, that is wherein $L/D \approx 1$ (where D = the caliber of the gun tube).

Moreover, in the above mentioned prior art kinetic energy projectiles the distance x between the trailing edge of the sabot and the base surface of the air pocket in the second support (pressure flange) should be relatively short so that the following generally applies: $x < 0.45 * \iota$, where $\iota$ is the length of the sabot which supports the penetrator, i.e., the length of the sabot in contact with the surface of the penetrator. However, this means that the sabot is unable to roll off over its trailing edge (the term "roll off" is understood to mean the opening of the sabot segments at the front while maintaining contact with the penetrator at the rear of the sabot). Rather, the resulting air attack force here acts in the immediate vicinity of the center of gravity of the sabot so that the sabot segments are released in parallel. This is undesirable, particularly for performance enhanced kinetic energy projectiles whose sabots have a long gas pressure charging surface at the rear.

It is an object of the present invention to further develop a subcaliber kinetic energy projectile of the above-mentioned type in such a way that, on the one hand, it is ensured that the sabot is able to roll off over its trailing edge in a reproducible manner and, on the other hand, the mass of the sabot in the front region is reduced. In addition, pendulum movements of the projectile caused by pressure fluctuations in the forward air pocket are to be avoided.

SUMMARY OF THE INVENTION

The above object generally is achieved according to the present invention by a subcaliber kinetic energy projectile of the type comprising a penetrator and a segmented sabot mounted on and surrounding a portion of the length of the penetrator, with the sabot having a first full-caliber support at its front and a second full-caliber support disposed at an axial distance behind the first support, with the second support including a rotationally symmetrical air pocket formed in its end surface facing the first support which is provided with air passage openings; and wherein:

(a) $L/D \geqq 1.2$ where L is the length of the penetrator tip ahead of the the support and D the full caliber;

(b) $x \geqq 0.45 * \iota$, where x is the distance between a trailing edge of the sabot and a base surface of the air pocket in the second support, and $\iota$ is the distance between the trailing edge of said sabot and the leading edge of the sabot on the outer surface of the penetrator; and (c) the first support is composed of at least three laterally extending web-like components whose shape and dimensions are such that the web-like components form three separate air pockets which are separated by the air passage openings.

Preferably the ratio L/D is approximately equal to 1.5 and the web-like components each meet the following conditions:

$$b \geqq d$$

$$b/5 \leqq a \leqq b$$

$$a \geqq 2/3 * t$$

$$0 \leqq \delta \leqq 35°$$

where d is the diameter of the penetrator, b is the average width of each web-like component, a is the distance between a front edge of a support surface of a web-like component and a leading edge of the sabot at an outer surface of the penetrator, t is the axial depth of an air pocket of the first support, and $\delta$ is the inclination angle of the frontal surface of a web-like component relative to a plane that is radial with respect to the longitudinal axis of the projectile.

According to the preferred embodiment of the invention, $a \approx 0.25 * b$ and/or $a = t$.

The present invention is thus essentially based on the concept of ensuring, on the one hand, by the selection of the distance x, and by the configuration of the first support including three separate air pockets, that the sabot reliably rolls off over its trailing edge. The geometric dimensions of the webs, particularly the forward web surfaces, must here be selected in such a way that these webs act as air pockets. On the other hand, air passage openings in the first support reduce the mass of the sabot. Since the webs do not form a rotationally symmetrical air pocket and the ratio $L/D \geqq 1.2$, and is preferably about 1.5, annoying pressure fluctuations in the forward air pockets do not occur.

Further details and advantages of the invention will be described below in greater detail with reference to an embodiment thereof that is illustrated in the drawing figures.

DETAILED DESCRIPTION OF THE PREFERRED EMBODIMENT

Figure 1:
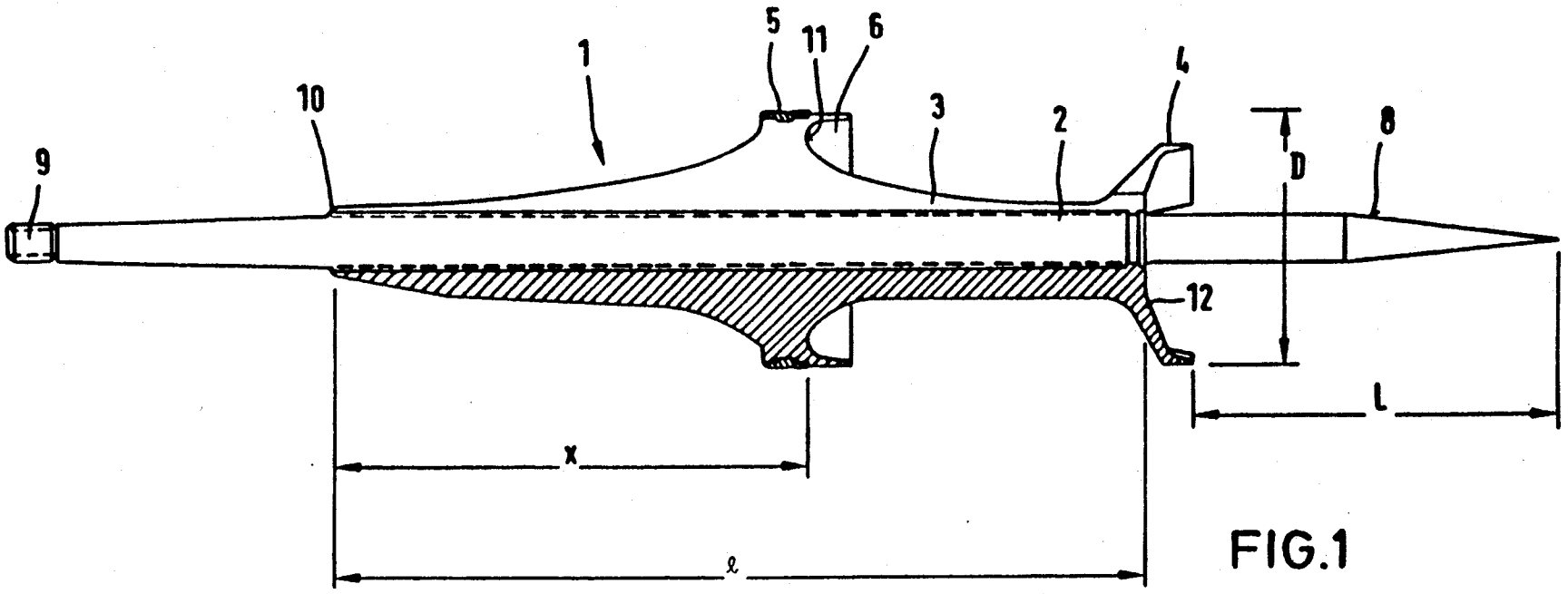
FIG. 1 is a partial longitudinal sectional view of a kinetic energy projectile according to the invention.
Figure 2:
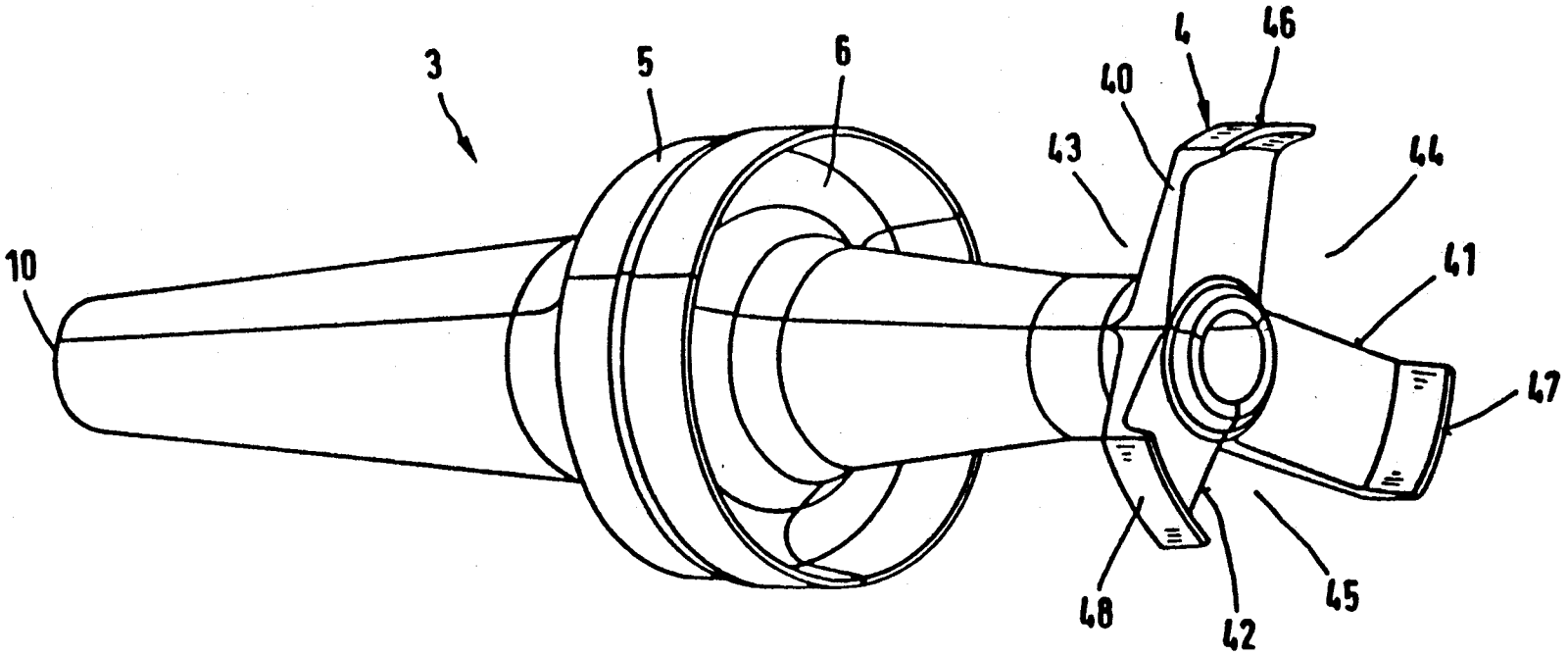
FIG. 2 is a perspective view of a sabot for a preferred embodiment of a kinetic energy projectile according to the invention.

Referring now to FIG. 1, there is shown a kinetic energy projectile 1 composed of a penetrator 2 and a sabot 3 that , in a known and conventional manner is segmented in the longitudinal direction of the projectile 1. The forward portion of sabot 3 is provided with a first full-caliber radial support 4 and the rear portion of sabot 3 is provided with a second full-caliber radial support 5 (see also FIG. 2). The end surface of the second support 5 facing the first support 4 is provided with a rotationally symmetrical air pocket 6. The first support 4 is composed of, for example, three separate web-like components 40, 41 and 42, which are shaped and dimensioned to form three separate air pockets, with air passage openings 43 to 45 being disposed between the web-like components 40 to 42 through which, during the flight of kinetic energy projectile 1, air is able to enter the rotationally symmetrical air pocket 6. The web-like components 40 to 42 are additionally provided with axially and forwardly extending supporting surfaces 46, 47 and 48 which, during flight of kinetic energy projectile 1 through the gun tube, lie against the latter. Preferably, as shown, the width of the individual web-like components 40–42 increases with radial distance from the surface of the penetrator 2.

Penetrator 2 has a tip 8 whose length ahead of the first support 4 is marked L. The rear portion of the penetrator 2 is provided with a threaded portion 9 onto which a non-illustrated fin guide mechanism is screwed in the customary manner. Additionally, the space between the trailing edge 10 of the sabot 3 and the leading edge 12 of the sabot at the outer surface of the penetrator 2 is marked $\iota$, the distance between the trailing edge 10 of the sabot and the base surface 11 of the rotationally symmetrical air pocket 6 is marked x, while the caliber of the projectile is D.

In order to prevent annoying pressure fluctuations in the forward web-like components 40 to 42, it is necessary to select the length L of the exposed penetrator tip 8 in such a way that the following applies:

$$L/D \geqq 1.2 \quad (1)$$

Preferably L/D should have a value of 1.5.

Two points must be observed with respect to the requirement for a reliable roll-off of sabot 3 over its trailing edge 10. Firstly, the distance x must be selected so that the following relationship exists:

$$x \geqq 0.45 * \iota \quad (2)$$

Secondly, the web-like components 40 to 42 must be configured in such a way that they each have the effect of an air pocket and nevertheless have the smallest mass possible. The configuration and effect of web-like components 40 to 42 will therefore be discussed in greater detail with reference to FIGS. 3 to 6.

Figure 3:
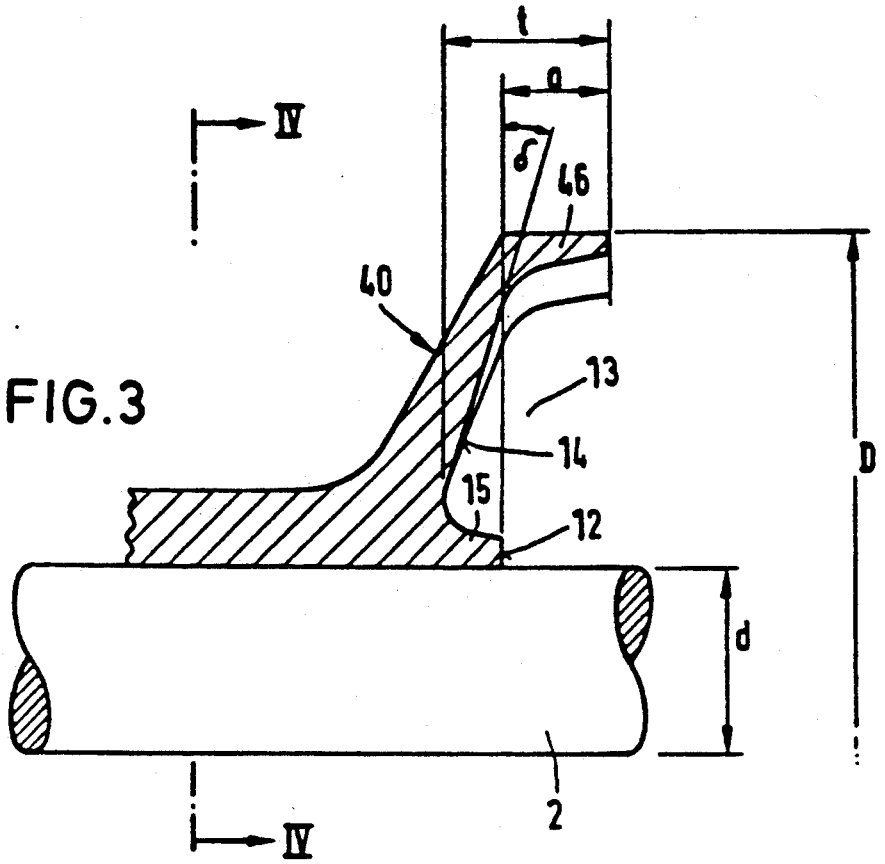
FIGS. 3 and 4 are a longitudinal sectional view and a cross-sectional view, respectively, of a web-like component of the first or front support of a sabot according to the invention.

FIG. 3 is a somewhat more detailed cross-sectional view of a web-like component 40 and its axial support surface 46. The air pocket, which has an axial depth t, formed by the component 40 is here marked 13 and the frontal face or end surface of web-like component 40 is marked 14. The angle of inclination of the face 14 relative to a plane that is radial (perpendicular) with respect to the longitudinal axis of the projectile 2–3 is marked δ. The sabot 3 is further provided with a nose-like sabot projection 15. The distance between the front edge of the respective supporting surface 46 and the leading edge 12 of the sabot 3 at the outer surface of the penetrator 2 is given the letter a.

Figure 4:
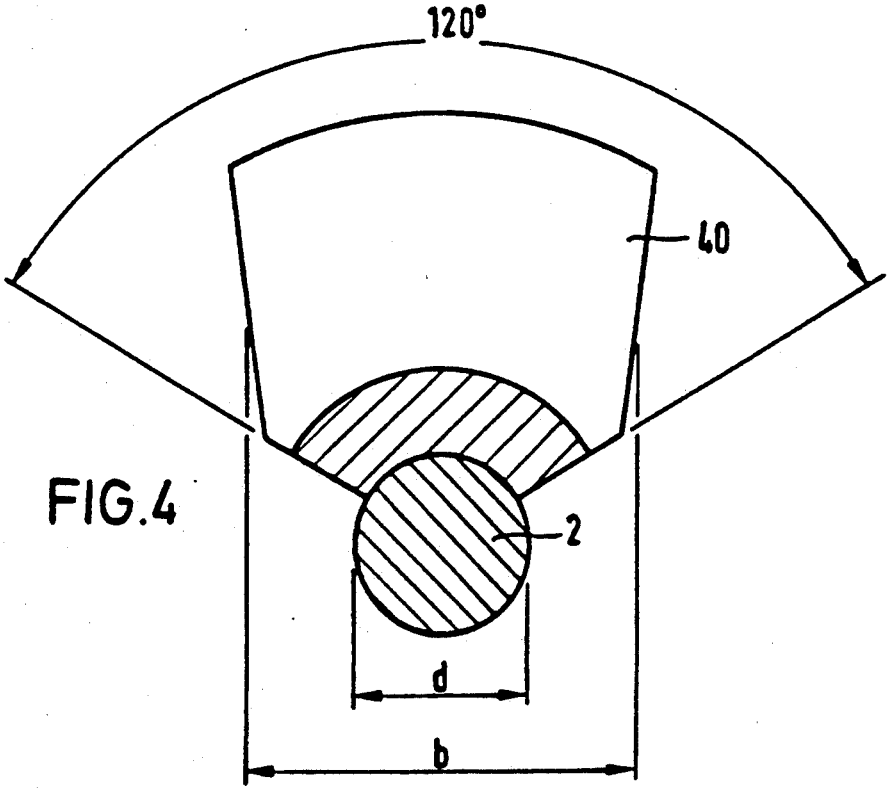

FIG. 4 is a cross-sectional view of the sabot arrangement shown in FIG. 3 seen along the section line marked IV—IV in FIG. 3, with the web-like component 40 having an average width b in the radial direction.

Web-like components 40 to 42 (FIG. 2) of the first or front support 4 thus essentially perform two functions. Firstly they also provide, like the first or front support in DE-OS 3,314,749 and corresponding U.S. Pat. No. 4,608,927, a radial support for sabot 3 when the kinetic energy projectile passes through the gun tube. Secondly, the aerodynamic forces required for the release of the sabot segments from penetrator 2 are introduced in a positive manner as a function of the parameters indicated at the top in FIGS. 3 and 4 (average web width b, axial air pocket depth t, distance a, inclination angle δ, etc.).

Thus, for example, the effect of the web-like components 40 to 42 as air pockets increases with increasing average width b of the webs and also with decreasing inclination angle δ. It has been found that the average width b should be equal to or greater than the penetrator diameter d and that the inclination angle should advantageously have a value between 0° and 35°.

Figure 5B:
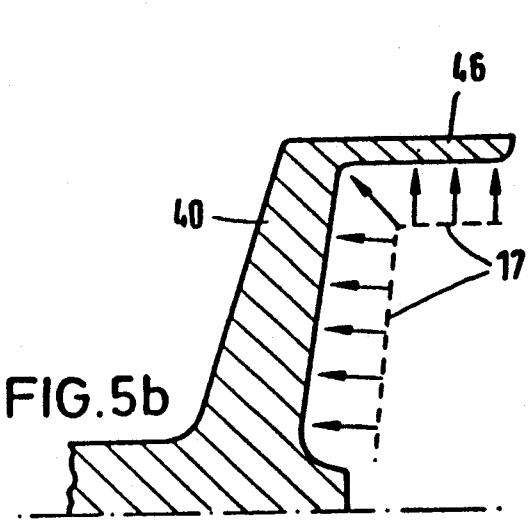
FIGS. 5*a* and 5*b* depict the flow conditions at a web-like component of the type shown in FIGS. 3 and 4 when the angle of inclination δ is small.
Figure 5A:
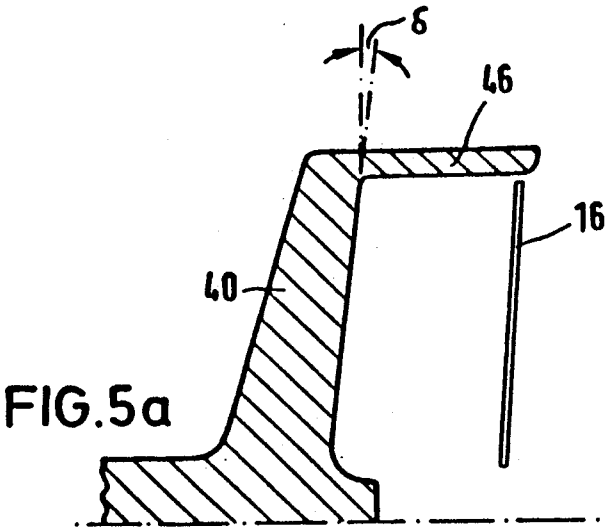

The influence of inclination angle δon the release behavior of the sabot segments will be described with reference to FIGS. 5*a*, 5*b*, 6*a* and 6*b*. FIGS. 5*a* and 5*b* depict a web-like component 40 for which the inclination angle is <35°, while in FIGS. 6*a* and 6*b* the web-like component marked 40' has an inclination angle of >35°.

Figure 6B:
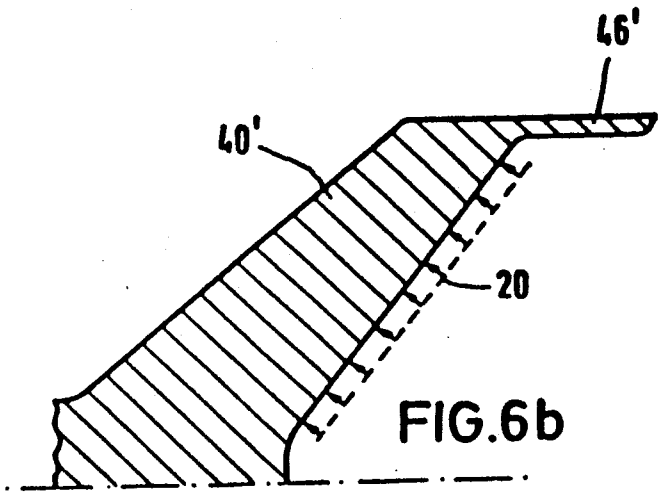
FIGS. 6*a* and 6*b* the flow conditions at a web-like component of the type shown in FIGS. 3 and 4 when the angle of inclination δ is large.
Figure 6A:
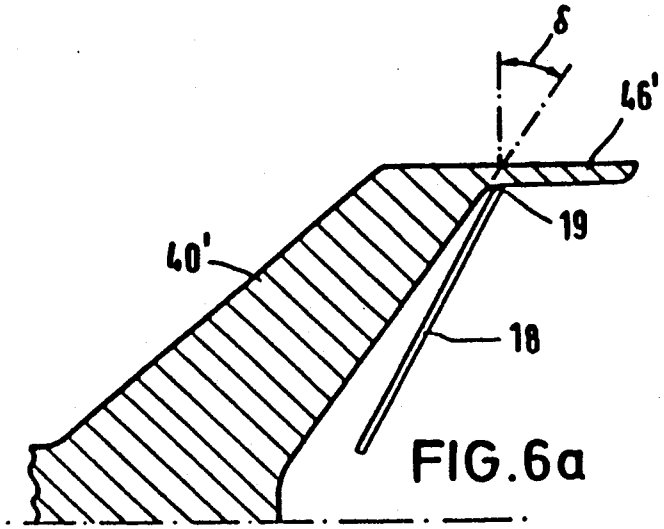

As shown in FIGS. 5*a* and 5 *b*, ultrasonic air flow at web-like component 40 causes a compression wave marked 16 to develop upstream of the air pocket (FIG. 5*a*) at the beginning of the release of sabot 3 at greater pressure compared to the external flow (in FIG. 5*b*, the pressure charge is indicated by the reference numeral 17) so that primarily the pressure force acting with great leverage on support face 46 generates a torque relative to the roll-off or trailing edge 10 (FIG. 1) of the sabot 3. If, however, angle δ becomes larger than 35° (FIG. 6*a*), an oblique compression wave marked 18 in FIG. 6*a* is present only in front of the-frontal face 14' of web-like component 40'. This wave starts at edge 19 and exhibits a significantly slower pressure increase than compression wave 16. In that case, the interior of support face 46' is therefore not charged with increased pressure (FIG. 6b) and is thus ineffective for the release function (the corresponding pressure charge is indicated in FIG. 6b by the reference numeral 20).

Moreover, for the case of FIG. 5a must be considered that the axial distance between the leading edge 12 of the sabot 3 at the surface of the penetrator 2 and the wave front of compression wave 16 is a function of the average width of web-like component 40 and lies between b/5 and b/2, with the pressure increase occurring only downstream of the wave front of compression wave 16. It has been found to be particularly advantageous for the distance a (FIG. 3) to lie between b/5 and b/2, and preferably for the distance a to be approximately equal to 0.25b. This design criterion ensures maximum aerodynamic radial components for initiation of the desired roll-off movement with minimum air pocket weight. However, for distance values between b/2 and b as well, sufficiently fast roll-off movements have resulted in spite of the larger web masses.

Finally, if the sabot has a nose-like projection 15, as indicated in FIG. 3, to guide the penetrator 2 at its tip, care must be taken that the following relationship is met:

$$a \geqq 2/3 * t$$

This is necessary because the nose-shaped projection 15, on the one hand, increases the weight of the sabot 3 and, on the other hand, reduces the resulting radial force component, which thus necessitates a broader web-like component 40 which again leads to an increase in weight of the sabot 3.

The above shows that, for a projectile according to the invention which is provided with web-like components 40 to 42 that act as air pockets, the following conditions must be met in addition to Equations (1) and (2) for the geometric parameters a, b, d, t and δ in order to solve the problem stated above (see also FIG. 3):

$$b \geqq d$$

$$b/5 \leqq a \leqq b$$

$$a \geqq 2/3 * t$$

$$0 \leqq \delta \leqq 35°$$

The invention now being fully described, it will be apparent to one of ordinary skill in the art that any changes and modifications can be made thereto without departing from the spirit or scope of the invention as set forth herein.

What is claimed is:

1. In a subcaliber kinetic energy projectile comprising a penetrator and a segmented sabot mounted on and surrounding a portion of the length of said penetrator, with said sabot having a first full-caliber support at its front and a second full-caliber support disposed at an axial distance behind said first support, with said second support including a rotationally symmetrical air pocket formed in its end surface facing said first support, and with said first support being provided with air passage openings; the improvement wherein:

(a) $L/D \geqq 1.2$ where L is the length of the penetrator tip ahead of the first support and D the full caliber;

(b) $x \geqq 0.45 * \iota$, where x is the distance between a trailing edge of said sabot and a base surface of said air pocket in said second support, and $\iota$ is the distance between said trailing edge of said sabot and a leading edge of said sabot on the outer surface of said penetrator; and (c) said first support is composed of at least three laterally extending web-like components whose shape and dimensions are such that said web-like components form three separate air pockets which are separated by said air passage openings.

2. A subcaliber projectile as defined in claim 1, wherein said ratio of L/D is approximately equal to 1.5.

3. A subcaliber projectile according to claim 2, wherein said web-like components of said front support each meet the following conditions:

$$b \geqq d$$

$$b/5 \leqq a \leqq b$$

$$a \geqq 2/3 * t$$

$$0 \leqq \delta \leqq 35°$$

where d is the diameter of said penetrator, b is the average width of a respective web-like component, a is the distance between a front edge of a support surface of a respective web-like component and a leading edge of said sabot at an outer surface of said penetrator, t is the axial depth of a respective air pocket of said first support, and δ is the inclination angle of a frontal surface of a respective said web-like component relative to a plane that is radial with respect to the longitudinal axis of the projectile.

4. A subcaliber kinetic energy projectile as defined in claim 3, wherein:

$$a \approx 0.25 * b.$$

5. A subcaliber projectile as defined in claim 4, wherein the following applies for the distance a:

$$a = t$$

6. A subcaliber projectile according to claim 1, wherein said web-like components of said front support each meet the following conditions:

$$b \geqq d$$

$$b/5 \leqq a \leqq b$$

$$a \geqq 2/3 * t$$

$$0 \leqq \delta \leqq 35°$$

where d is the diameter of said penetrator, b is the average width of a respective web-like component, a is the distance between a front edge of a support surface of a respective web-like component and a leading edge of said sabot at an outer surface of said penetrator, t is the axial depth of a respective air pocket of said first support, and $\delta$ is the inclination angle of a frontal surface of a respective said web-like component relative to a plane that is radial with respect to the longitudinal axis of the projectile.

7. A subcaliber kinetic energy projectile as defined in claim 6, wherein:

$$a \approx 0.25 * b.$$

8. A subcaliber projectile as defined in claim 7, wherein the following applies for the distance a:

$$a = t.$$

9. A subcaliber projectile as defined in claim 3, wherein the following applies for the distance a:

$$a = t.$$

* * * * *